US008911220B2

(12) United States Patent
Hattori et al.

(10) Patent No.: US 8,911,220 B2
(45) Date of Patent: Dec. 16, 2014

(54) ELECTRIC FLUID PUMP AND MOLD FOR INSERT-MOLDING CASING OF ELECTRIC FLUID PUMP

(75) Inventors: Shuji Hattori, Nagoya (JP); Atsushi Unno, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 750 days.

(21) Appl. No.: 12/637,491

(22) Filed: Dec. 14, 2009

(65) Prior Publication Data

US 2010/0158703 A1 Jun. 24, 2010

(30) Foreign Application Priority Data

Dec. 22, 2008 (JP) ..... 2008-325673

(51) Int. Cl.

| | |
|---|---|
| ***F04B 35/04*** | (2006.01) |
| ***F04D 29/02*** | (2006.01) |
| ***F04D 29/046*** | (2006.01) |
| ***F04D 13/06*** | (2006.01) |

(52) U.S. Cl.

CPC ..... *F04D 13/06* (2013.01); *F04D 29/026* (2013.01); *F04D 29/046* (2013.01)

USPC ..... 417/423.7; 417/423.14; 417/423.1

(58) Field of Classification Search

CPC ..... F04D 29/426; F04D 29/04; F04D 7/02; F04D 13/0633; F04D 13/0613; F04D 29/044; F04D 29/043; A61M 1/101

USPC ..... 417/423.1, 423.14, 424.1, 423.7, 410.1, 417/423.12

See application file for complete search history.

(56) References Cited

U.S. PATENT DOCUMENTS

| | | | | |
|---|---|---|---|---|
| 2,165,191 | A * | 7/1939 | Kucher | 261/78.1 |
| 2,782,720 | A * | 2/1957 | Dochterman | 417/357 |
| 2,805,626 | A * | 9/1957 | Pezzillo et al. | 417/357 |

(Continued)

FOREIGN PATENT DOCUMENTS

| | | |
|---|---|---|
| DE | 1 943 309 | 3/1971 |
| DE | 196 22 286 A1 | 11/1996 |
| EP | 1 580 434 A1 | 9/2005 |
| JP | 2002-147256 A | 5/2002 |

OTHER PUBLICATIONS

Extended European Search Report dated Aug. 9, 2011, issued by the European Patent Office in corresponding European Patent Application No. 09 01 5386.

*Primary Examiner* — Alexander Comley

(74) *Attorney, Agent, or Firm* — Buchanan Ingersoll & Rooney PC

(57) ABSTRACT

An electric fluid pump includes a casing, a rotor arranged in the casing, and a shaft member supported by the casing and including a shaft portion extending in the casing in a direction of an axis of the shaft member, having a first end portion arranged at one axial end of the shaft member and a second end portion arranged at the other axial end of the shaft member, and supporting the rotor, a collar portion arranged at the first end portion of the shaft portion and embedded in the casing, and a stepped section arranged between the shaft portion and the collar portion, positioned closer to the second end portion of the shaft portion than the first end portion of the shaft portion, and configured to have an end face facing the second end portion and serving as a bearing surface on which the rotor is rotatably supported.

13 Claims, 5 Drawing Sheets

(56) References Cited

U.S. PATENT DOCUMENTS

| | | | | | |
|---|---|---|---|---|---|
| 2,920,575 | A | * | 1/1960 | White et al. | 417/63 |
| 2,942,555 | A | * | 6/1960 | Pezzillo | 417/372 |
| 3,513,942 | A | * | 5/1970 | Sato | 184/6 |
| 3,520,642 | A | * | 7/1970 | Fulton | 417/420 |
| 3,853,429 | A | * | 12/1974 | Wiedenmann | 417/356 |
| 4,644,202 | A | * | 2/1987 | Kroy et al. | 310/58 |
| 4,985,181 | A | * | 1/1991 | Strada et al. | 261/87 |
| 5,641,275 | A | * | 6/1997 | Klein et al. | 417/420 |
| 5,714,814 | A | * | 2/1998 | Marioni | 310/87 |
| 6,065,946 | A | * | 5/2000 | Lathrop | 417/423.14 |
| 6,071,091 | A | * | 6/2000 | Lemieux | 417/423.1 |
| 6,132,186 | A | * | 10/2000 | Cooper et al. | 417/423.7 |
| 6,293,772 | B1 | * | 9/2001 | Brown et al. | 417/420 |
| 6,524,083 | B2 | * | 2/2003 | Deai et al. | 417/370 |
| 6,896,494 | B2 | * | 5/2005 | Sunaga et al. | 417/423.1 |
| 7,131,823 | B2 | * | 11/2006 | Kalavsky | 417/356 |
| 7,249,939 | B2 | * | 7/2007 | Yanagihara et al. | 417/420 |
| 2001/0033800 | A1 | * | 10/2001 | Deai et al. | 417/370 |
| 2004/0234395 | A1 | * | 11/2004 | Hatano | 417/420 |
| 2006/0057005 | A1 | * | 3/2006 | Williams et al. | 417/423.14 |
| 2006/0057006 | A1 | * | 3/2006 | Williams et al. | 417/423.14 |
| 2006/0251513 | A1 | * | 11/2006 | Kalavsky et al. | 415/206 |
| 2007/0018521 | A1 | * | 1/2007 | Ishiguro et al. | 310/156.43 |
| 2008/0112824 | A1 | * | 5/2008 | Sawasaki et al. | 417/423.7 |

* cited by examiner

ELECTRIC FLUID PUMP AND MOLD FOR INSERT-MOLDING CASING OF ELECTRIC FLUID PUMP

CROSS REFERENCE TO RELATED APPLICATIONS

This application is based on and claims priority under 35 U.S.C. §119 to Japanese Patent Application 2008-325673, filed on Dec. 22, 2008, the entire content of which is incorporated herein by reference.

TECHNICAL FIELD

This disclosure relates to an electric fluid pump and a mold for insert-molding a casing of the electric fluid pump.

BACKGROUND DISCUSSION

A known rotor includes a rotary shaft (shaft member) supported by a casing made of resin around an axis of the rotary shaft. Fluid is fed, for example, to an engine by a turning force of the rotor. When an electric fluid pump including such rotor is used for many years, a bending moment, a turning force, and a pulling force act on a connecting portion between the rotary shaft and the casing, therefore decreasing a connecting strength of the connecting portion and causing the rotary shaft to be loosened and detached from the casing. A known connecting mechanism by which a rotary shaft is firmly fixed to a casing made of, for example, resin is disclosed in JP2002-147256A (hereinafter referred to as Patent Document 1). According to the connecting mechanism disclosed in Patent Document 1, the rotary shaft includes an end portion embedded in the resin so as to be fixed thereto and recessed and convex portions are formed on a surface of the end portion of the rotary shaft in such a way that a spiral groove is formed around an axis of the rotary shaft. The recessed and convex shapes of the surface of the rotary shaft improve an engaging ability of the rotary shaft with the resin.

However, according to Patent Document 1, since the connecting strength of the connecting portion between the rotary shaft and the casing depends on the recessed and convex shapes of the surface of the rotary shaft, the rotor is not surely resistive against a turning force applied to the rotary shaft. That is, a resisting force of the connecting portion is determined by an outer diameter of the rotary shaft and the rotary shaft may be gradually loosened from the casing as the rotor is used for many years. Further, since an area of the surface of the end portion of the rotary shaft, which is resistive to the above-mentioned bending moment and pulling force, is small, the rotary shaft may be loosened and detached from the casing. Thus a firm connecting strength of the connecting portion between the rotary shaft and the casing is not surely obtained by the connecting mechanism disclosed in Patent Document 1.

Furthermore, when an axial length of the connecting portion between the rotary shaft and the resin casing is elongated, the connecting strength therebetween is increased; however, the electric fluid pump may be increased in the axial length.

Moreover, no standard for positioning the rotary shaft relative to the casing is established in Patent Document 1. For example, when the rotary shaft is inserted in a mold for insert-molding the casing with resin, the rotary shaft is required to be surely fixed to the mold. Thus the mold may require a complicated configuration. When the standard for positioning the rotary shaft relative to the casing is not established, the rotary shaft is inaccurately positioned in the mold, thereby deteriorating the operating accuracy of the rotor and causing vibrations of the rotor. As a result, a bending moment and a pulling force acting on the rotary shaft may be further increased.

A need thus exists for an electric fluid pump and a mold for insert-molding a casing of the electric fluid pump, which are not susceptible to the drawback mentioned above.

SUMMARY

According to an aspect of this disclosure, an electric fluid pump including a casing, a rotor arranged in the casing, and a shaft member supported by the casing and including a shaft portion extending in the casing in a direction of an axis of the shaft member, having a first end portion arranged at one axial end of the shaft member and a second end portion arranged at the other axial end of the shaft member, and supporting the rotor, a collar portion arranged at the first end portion of the shaft portion, embedded in the casing, and having an outer diameter larger than an outer diameter of the shaft portion, and a stepped section arranged between the shaft portion and the collar portion, positioned closer to the second end portion of the shaft portion than the first end portion of the shaft portion, and including an outer diameter smaller than the outer diameter of the collar portion and larger than the outer diameter of the shaft portion, the stepped section being configured to have an end face facing the second end portion of the shaft portion and serving as a bearing surface on which the rotor is rotatably supported.

According to another aspect of the disclosure, a mold for insert-molding a casing of an electric fluid pump including a rotor and a shaft member having a shaft portion, a collar portion, and a stepped section, the shaft portion extending in the casing in a direction of an axis of the shaft member, having a first end portion arranged at one axial end of the shaft member and a second end portion arranged at the other axial end of the shaft member, and supporting the rotor, the collar portion being arranged at the first end portion of the shaft portion, embedded in the casing, and having an outer diameter larger than an outer diameter of the shaft portion, the stepped section being arranged between the shaft portion and the collar portion, positioned closer to the second end portion of the shaft portion than the first end portion of the shaft portion, and having an end face facing the second end portion of the shaft portion and serving as a bearing surface on which the rotor is rotatably supported, the mold includes: a first mold and a second mold forming a cavity in combination with the first mold for injecting resin, the first mold including a first mold surface for molding a portion of an inner surface of the casing, wherein the shaft portion of the shaft member is inserted in a condition where the bearing surface of the stepped portion is in contact with the first mold surface of the first mold so that the first mold retains the shaft member.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

An embodiment in which an electric fluid pump disclosed here is applied to an electric water pump P for a vehicle will be explained with illustrations of drawings as follows.

(Overall Configuration of the Electric Fluid Pump)

Figure 1:
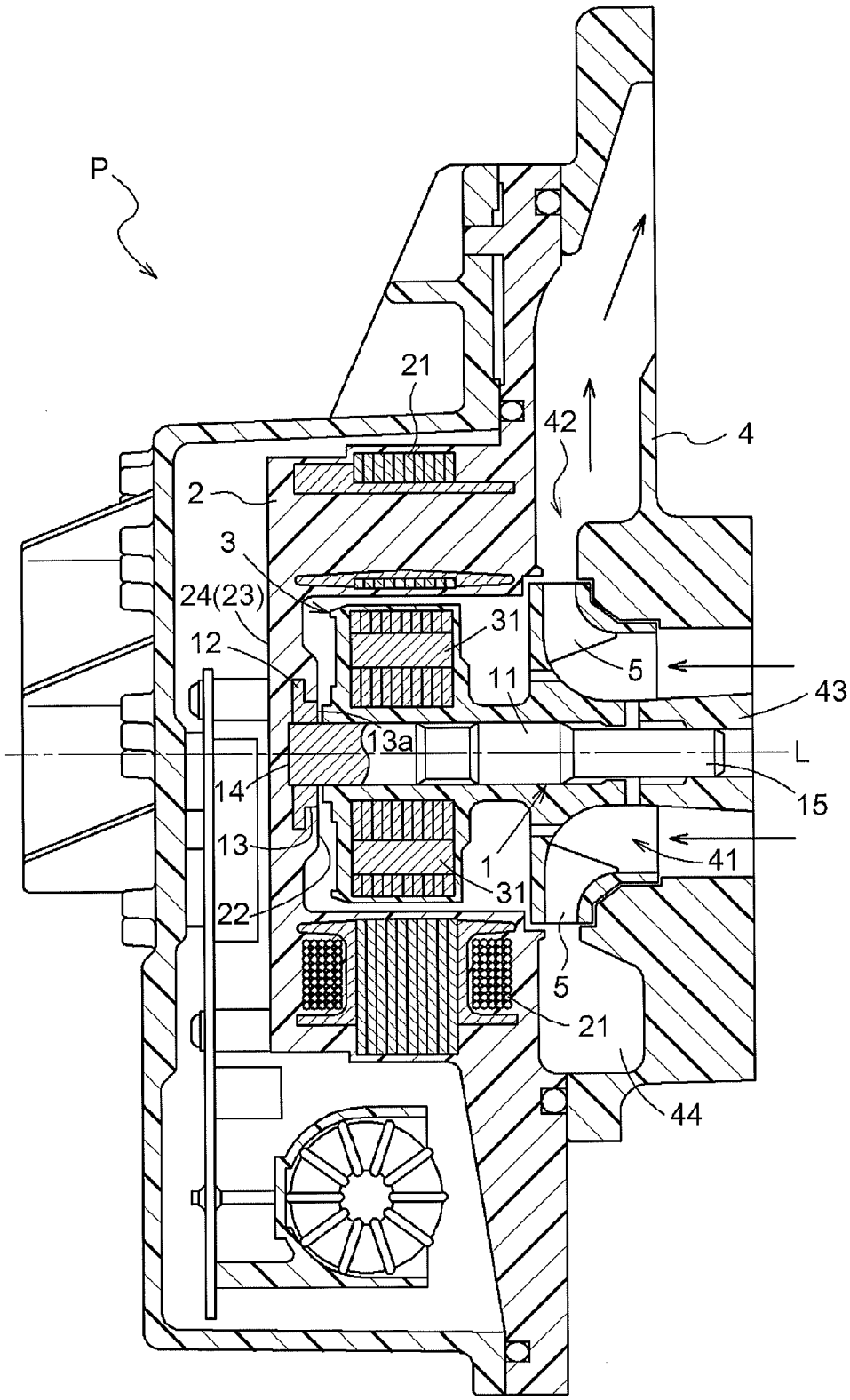
FIG. 1 is a cross-sectional view showing an overall configuration of an electric fluid pump according to an embodiment disclosed here.

As shown in FIG. 1, the electric water pump P serving as the electric fluid pump includes a casing 2 made of resin, a shaft member 1 made of metal, a housing 4, a rotor 3, and impeller vanes 5 attached to the rotor 3. The shaft member 1 includes a first end portion 14 positioned at one axial end of the shaft member 1 and a second end portion 15 positioned at the other axial end of the shaft member 1 in a direction of an axis L of the shaft member 1. The first end portion 14 of the shaft member 1 is fixed to the casing 2. The housing 4 accommodates the casing 2 while supporting the second end portion 15 of the shaft member 1 to be pivotal. The rotor 3 is supported by the shaft member 1 around the axis L of the shaft member 1. A coil 21 is arranged around the axis L of the shaft member 1 inside the casing 2 while a permanent magnet 31 is arranged around the axis L of the shaft member 1 inside the rotor 3. An electric current to be supplied to the coil 21 is controlled by an engine control unit and the rotor 3 is rotated by means of an electromagnetic force generated by the coil 21 to which the electric current is supplied. A rotating speed of the rotor 3 may be increased and decreased in accordance with adjustment of the amount of the electric current.

The housing 4 includes a suction port 41, a discharge port 42, and a supporting portion 43 supporting the shaft member 1. The suction port 41 is formed around the supporting portion 43. Cooling water is suctioned inside the electric water pump P through the suction port 41 toward the first end portion 14 of the shaft member 1 (to the left in FIG. 1) in the direction of the axis L while the cooling water is discharged out of the electric water pump P through the discharge port 42. A flow passage 44 continuously connecting the suction port 41 and the discharge port 42 to each other is formed around the axis L of the shaft member 1 so as to form a spiral shape.

A plurality of the impeller vanes 5 is provided in a radial pattern in the flow passage 44 near the discharge port 42. The impeller vanes 5 rotate integrally with the rotor 3 in accordance with the rotation of the rotor 3, thereby stirring cooling water into the flow passage 44. The cooling water is pushed radially outwardly along the spiral shape of the flow passage 44 and eventually discharged out of the electric water pump P through the discharge port 42. The flow passage 44 is configured with a diameter gradually increasing radially outwardly, therefore gradually decreasing a flow rate of the cooling water. As a result, the cooling water is prevented from flowing back inside the flow passage 44 when the impeller vanes 5 rotate.

As described above, the cooling water is fed out of the electric water pump P in accordance with the operation of the electric water pump P. The size of the coil 21 and the permanent magnet 31 and the number of the impeller vanes 5 may be determined according to need.

(Shaft Member and Casing)

Figure 2:
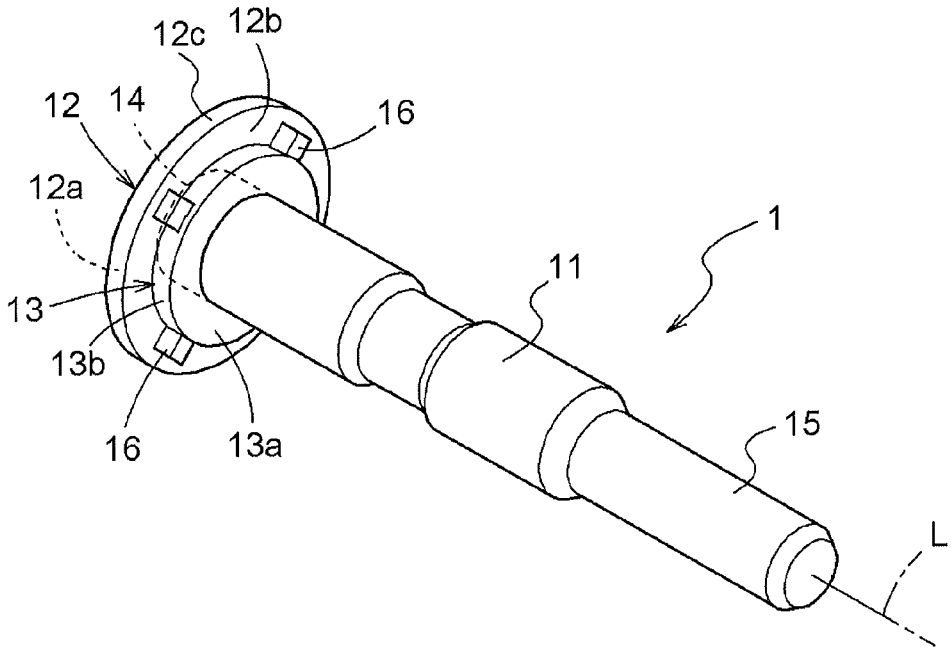
FIG. 2 is a perspective view of a shaft member of the electric fluid pump according to the embodiment disclosed here.

As shown in FIG. 2, the shaft member 1 includes a shaft portion 11, a collar portion 12, and a stepped section 13. The shaft portion 11 extends in the casing along the direction of the axis L and supports the rotor 3. The collar portion 12 is arranged at the first end portion 14 of the shaft member 1 in the direction of the axis L, more specifically, externally fitted to the shaft portion 11. The collar portion 12 forms an annular shape with an outer diameter larger than an outer diameter of the shaft portion 11. The stepped section 13 is arranged between the shaft portion 11 and the collar portion 12 and positioned closer to the second end portion 15 of the shaft portion 11 than the collar portion 12 in the direction of the axis L, more specifically, externally fitted to the shaft portion 11. The stepped section 13 forms an annular shape with an outer diameter smaller than the outer diameter of the collar portion 12 and larger than the outer diameter of the shaft portion 11.

The collar portion 12 forming the annular shape includes a first end face 12*a*, a second end face 12*b*, and an outer circumferential surface 12*c* formed between the first and second end faces 12*a*, 12*b*. The first end face 12*a* of the collar portion 12 is arranged so as to face the first end portion 14 in the direction of the axis L while the second end face 12*b* is arranged so as to face the second end portion 15 in the direction of the axis L. Meanwhile, the stepped section 13 also forming the annular shape includes an end face facing the second end portion 15 and an outer circumferential surface 13*b*. The end face of the stepped section 13 serves as a bearing surface 13*a*.

Figure 3:
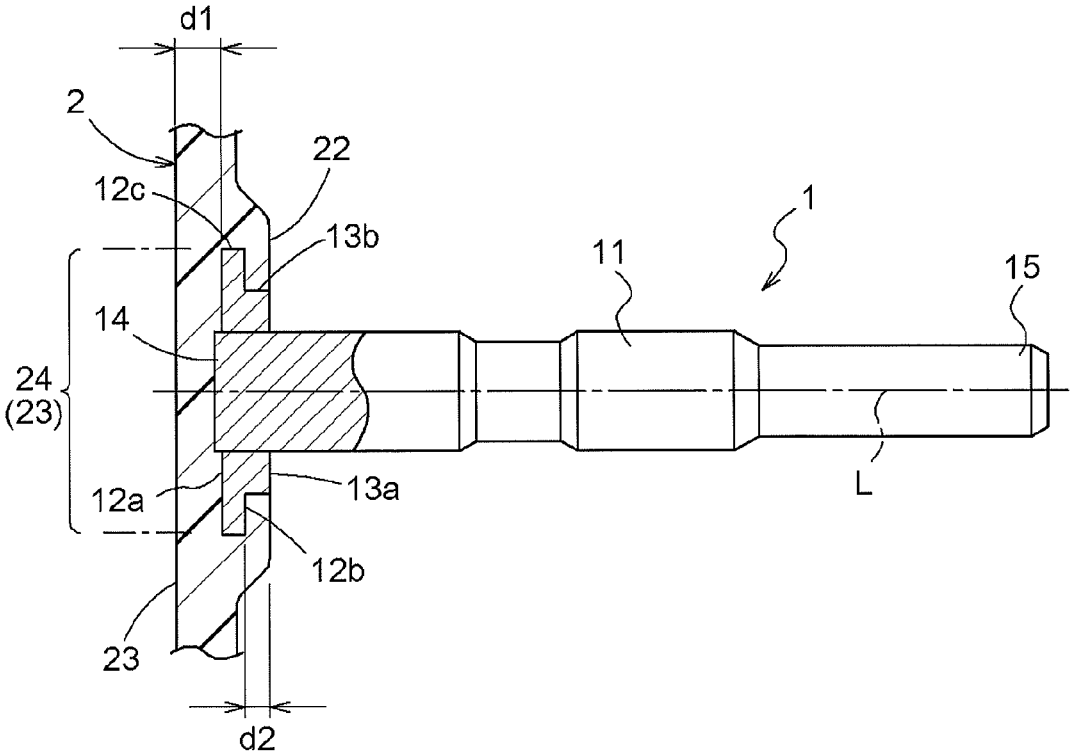
FIG. 3 is a cross-sectional view of an area near a connecting portion between a casing and the shaft member of the electric fluid pump according to the embodiment disclosed here.

As shown in FIG. 3, after the collar portion 12 and the stepped section 13 are integrally formed as a single-member, the shaft portion 11 is press fitted to the single member. Thus, since the shaft portion 11 is a separate portion from the single member of the collar portion 12 and the stepped section 13, manufacturing techniques depending on shapes of each member may be adapted, for example, casting for the shaft portion 11 and cutting for the collar portion 12 and the stepped section 13, therefore reducing manufacturing costs.

The collar portion 12 is embedded in the casing 2, thereby fixing the shaft member 1 to the casing 2. Even when a bending moment and a pulling force act on a connecting portion between the shaft member 1 and the casing 2, the first end face 12*a* and the second end face 12*b* of the collar portion 12 engage with the resin of the casing 2, thereby generating a strong resistive force against the bending moment and the pulling force. Conventionally, recessed and convex shapes formed on a surface of an end portion of a rotary shaft (shaft member) increase a connecting strength between the shaft member and a casing in order to prevent the shaft member from being loosened from the casing. Compared to such conventional connecting method, the connecting method in the embodiment provides a stronger connecting strength between the shaft member 1 and the casing 2, therefore further preventing the shaft member 1 from being loosened from the casing 2. Further, the bearing surface 13*a*, which is a bearing on which the rotor 3 is rotatably supported, is configured so as to be in plane with an inner surface 22 of the casing 2. Accordingly, the bearing surface 13*a* may act as a standard for positioning the shaft member 1 relative to the casing 2.

Figure 4A:
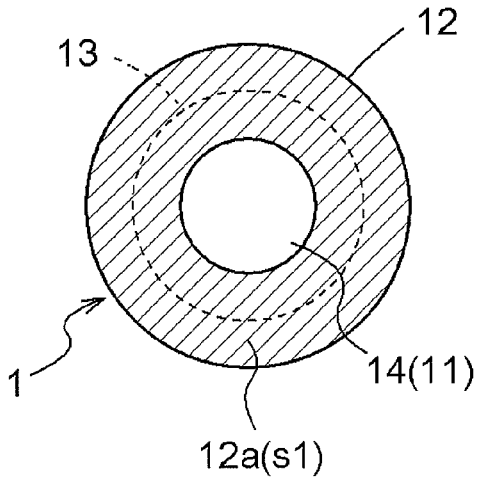
FIG. 4A is a lateral view of the shaft member seen from one direction of an axis of the shaft member.
Figure 4B:
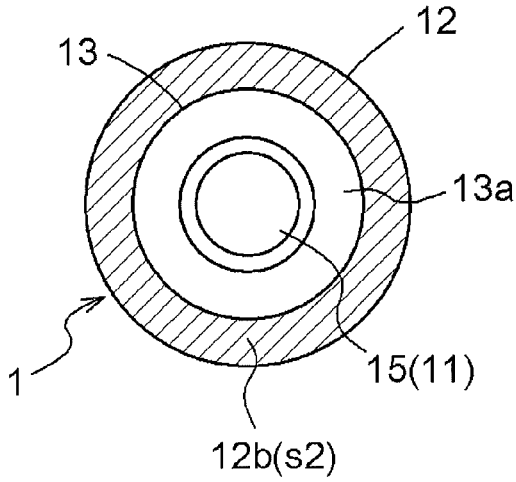
FIG. 4B is a lateral view of the shaft member seen from the other direction of the axis of the shaft member.

Further, the casing 2 includes a partial surface 24 of an outer surface 23 of the casing 2. The partial surface 24 faces the first end face 12*a* of the collar portion 12. In the vicinity of the partial surface 24, a first distance d1 defined between the outer surface 23 and the first end face 12*a* is set so as to be longer than a thickness of the stepped section 13 in the direction of the axis L, which is a second distance d2 defined between the second end portion 12*b* of the collar portion 12 and the bearing surface 13*a* of the stepped section 13. On a surface located at an extended position from the outer circumferential surface 12*c* in the direction of the axis L, the first distance d1 is surely longer than the second distance d2. Furthermore, FIG. 4A is a lateral view of the shaft member 1 seen from one side (the first end portion 14) in the direction of the axis L while FIG. 4B is a lateral view of the shaft member 1 seen from the other side (the second end portion 15) in the direction of the axis L. Here, as clearly seen in FIG. 4A and FIG. 4B, a first area s1 of the first end face 12*a* is larger than a second area s2 of the second end face 12*b*. A shaded area shown in FIG. 4A is the first area s1 of the first end face 12*a* and a shaded area shown in FIG. 4B is the second area s2 of the second end face 12*b*. In other words, the first area s1 of the first end face 12*a* having the first distance d1 relative to the outer surface 23 is set to be larger than the second area s2 of the second end face 12*b* in the vicinity of the partial surface 24. Further, an inlet port of a resin flow passage, which is defined between the partial surface 24 and the first area s1, is larger than an inlet port of a resin flow passage, which is defined between the second end face 12*b* and the bearing surface 13*a*. Accordingly, resin filled in a mold for insert-molding the casing 2 mainly flows in the resin flow passage between the partial surface 24 and the first area s1 and therefore a pressure of the resin, which is applied to the first end face 12*a*, is larger than a pressure of the resin, which is applied to the second end face 12*b*. Consequently, the bearing surface 13*a* is pressed against the mold. As a result, the shaft member 1 is retained in a stationary condition in a cavity 9 inside the mold during the insert-molding of the casing 2.

The shaft member 1 includes a plurality of protruding portions 16 protruding radially outwardly from the outer circumferential surface 13*b* of the stepped section 13. Accordingly, even when a turning force is applied to the shaft member 1 in accordance with the rotation of the rotor 3, the protruding portions 16 engage with the resin of the casing 2, thereby preventing deterioration of the connecting strength between the shaft member 1 and the casing 2. Further, it is effective to apply a knurling process and to form a groove in the outer circumferential surface 12*c* of the collar portion 12 or in the outer circumferential surface 13*b* of the stepped section 13 in order to prevent the shaft member 1 from rotating.

Figure 6A:
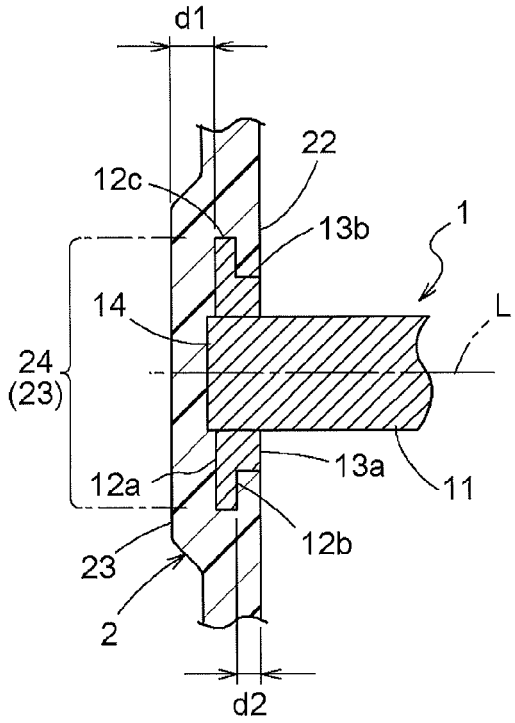
FIG. 6A is a cross-sectional view of an area near a connecting portion between the casing and the shaft member according to another example of the embodiment disclosed here.
Figure 6B:
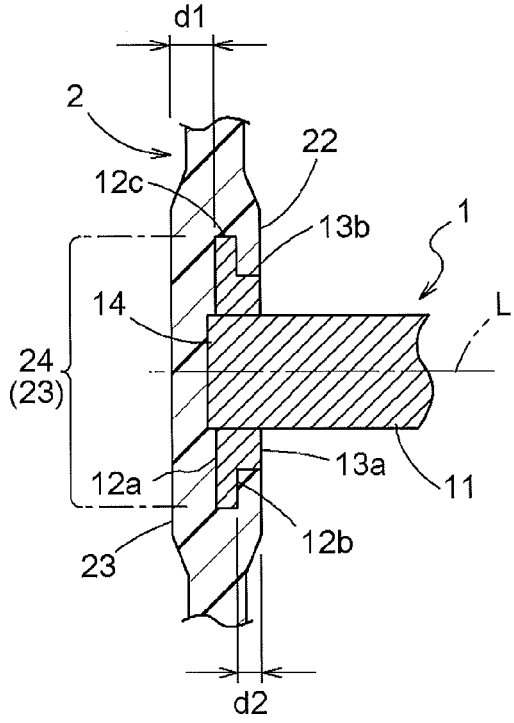
FIG. 6B is a cross-sectional view of an area near a connecting portion between the casing and the shaft member according to still another of the embodiment disclosed here.

In the embodiment, the casing 2 is configured so that the partial surface 24 is in plane with an adjacent area of the partial surface 24 and an adjacent area of the inner surface 22 facing the partial surface 24 is gradually thinned toward the end portion 15 of the shaft member 1 along the direction of the axis L. Since the above-described conditions where the first distance d1 is longer than the second distance d2 and the first area s1 is larger than the second area s2 are satisfied, the pressure of the resin applied to the first end face 12*a* is larger than the pressure of the resin applied to the second end face 12*b*. Moreover, as mentioned above, since the casing 2 is gradually thinned toward the end portion 15 of the shaft member 15 along the direction of the axis L, the axial thickness of the casing 2 is reduced. However, the configuration of the casing 2 is not limited to the above-described configuration. For example, as shown in FIG. 6A, the casing 2 is configured so that an adjacent portion of the outer surface 23 is gradually thinned toward the second end portion 15 of the shaft member 11 along the direction of the axis L, thereby reducing a thickness of the casing 2 in the direction of the axis L. Meanwhile, as shown in FIG. 6B, the casing 2 is configured so that an adjacent portion of the inner surface 22 is gradually thinned toward the end portion 15 of the shaft member 11 along the direction of the axis L and that an adjacent portion of the outer surface 23 is gradually thinned toward the second end portion 15 of the shaft member 11 along the direction of the axis L, thereby reducing the thickness of the casing 2 in the direction of the axis L. In addition, when the first area s1 of the first end face 12*a* having the first distance d1 longer than the second distance d2 is set so as to be larger than the second area s2 of the second end face 12*b* in the vicinity of the partial surface 24 and the resin flow passage in the vicinity of the partial surface 24 is established so as to be larger than the resin flow passage between the second end face 12*b* and the bearing surface 13*a*, the above-described effect may be appropriately obtained.

Figure 7A:
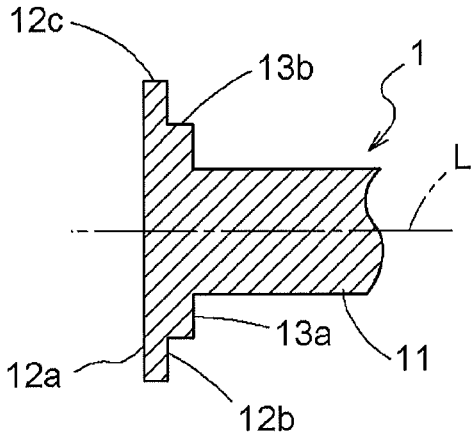
FIG. 7A is a cross-sectional view of the shaft member according to another example of the embodiment disclosed here.
Figure 7B:
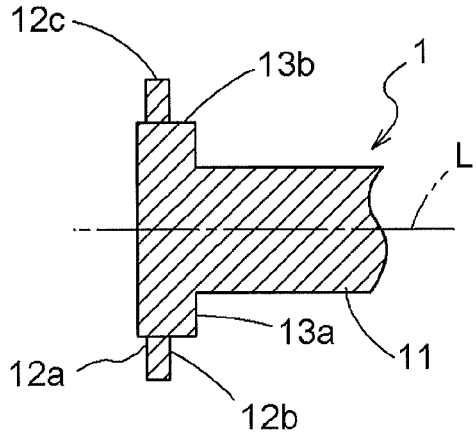
FIG. 7B is a cross-sectional view of the shaft member according to a still another of the embodiment disclosed here.

In addition, according to the embodiment, the shaft portion 11 is a separated member from the collar portion 12 and the stepped section 13; however, all the shaft portion 11, the collar portion 12, and the stepped section 13 may be integrally formed as a single member as shown in FIG. 7A. As shown in FIG. 7B, after the shaft portion 11 and the stepped portion 13 are integrally formed as a single member, the collar portion 12 is press-fitted to the single member of the shaft portion 11 and the stepped portion 13. As clearly seen from an example shown in FIG. 7A, the first area s1 of the first end face 12*a* is larger than the second area s2 of the second end face 12*b*. As clearly seen from an example shown in FIG. 7B, the first area s1 of the first end face 12*a* is equal to the second area s2 of the second end face 12*b*. Accordingly, when the first distance d1 between the outer surface 23 and the first end face 12*a* in the vicinity of the partial surface 24 is set so as to be longer than the second distance d2 between the second end face 12*b* and the bearing surface 13*a*, the above-described effect may be appropriately obtained in both of the examples shown in FIG. 7A and FIG. 7B.

Figure 8:
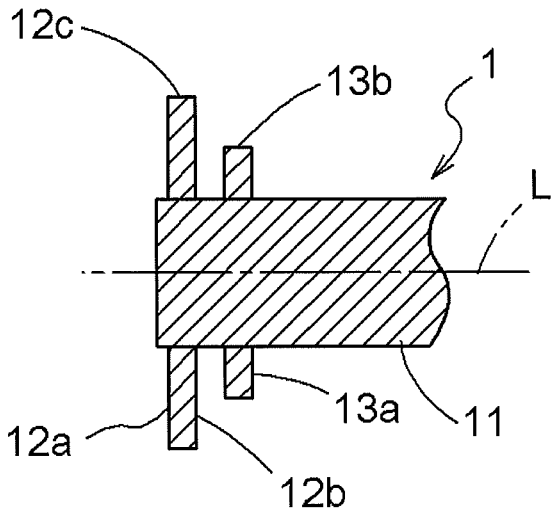
FIG. 8 is a cross-sectional view of the shaft member according to another example of the embodiment disclosed here.
Figure 9:
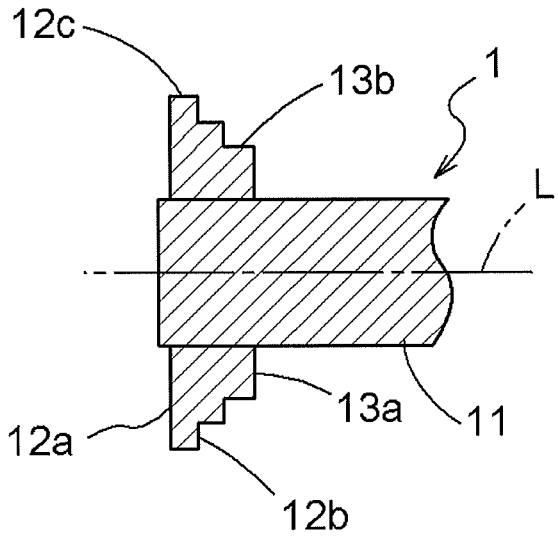
FIG. 9 is a cross-sectional view of the shaft member according to a still another of the embodiment disclosed here.

As shown in FIG. 8, it is not necessary for the collar portion 12 and the stepped section 13 to be adjacent and in contact to each other while it is acceptable for the collar portion 12 and the stepped section 13 to be away from each other. Further, as shown in FIG. 9, a portion having an outer diameter smaller than the outer diameter of the collar 12 and larger than the outer diameter of the stepped section 13 may be provided between the collar portion 12 and the stepped section 13. Further, a cross-sectional shape of the outer circumferential surface 12*c* and a cross-sectional shape of the outer circumferential surface 13*b* are not limited to the annular shapes. The cross-sectional shapes of the outer circumferential surfaces 12*c*, 13*b* may be polygonal shapes or irregular curved shapes depending on conditions for the casing 2 such as manufacturing dimensions.

(Insert Molding Mold for Casing)

An example of a mold 6 (hereinafter referred to as an insert-molding mold 6) for molding the casing 2 into which the shaft member 1 inserted as described above will be explained with reference to the drawings as follows.

Figure 5:
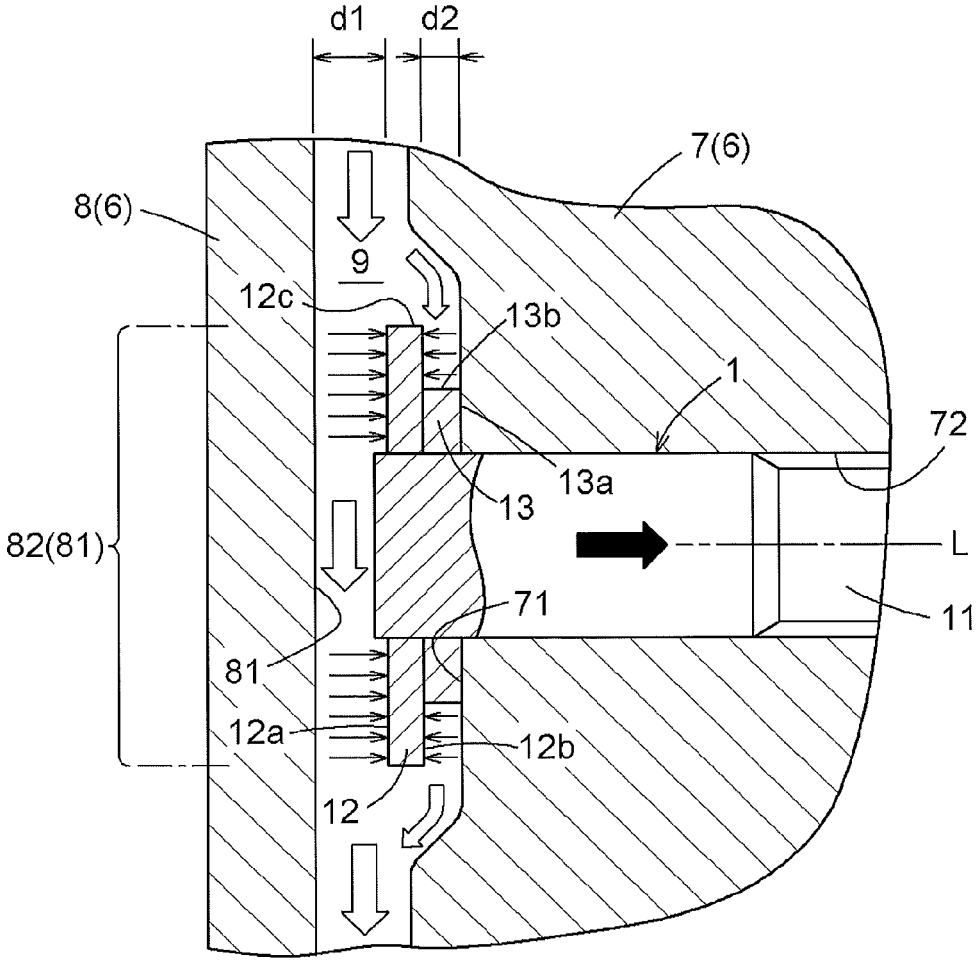
FIG. 5 is a cross-sectional view of a portion of a mold for insert-molding the casing according to the embodiment disclosed here.

As shown in FIG. 5, the insert-molding mold 6 includes first and second molds 7 and 8. The first mold 7 and the second mold 8 form the cavity 9 that is used for injecting the resin in the insert-molding mold 6. The first mold 7 includes a first mold surface 71 for molding at least a portion of the inner surface 22 of the casing 2. The first mold surface 71 has an inner diameter slightly larger than the outer diameter of the shaft portion 11 and a supporting through-hole 72 into which the shaft portion 11 is easily inserted and supported. Thus the first mold 7 retains the shaft member 1 in a condition where the bearing surface 13*a* is in contact with the first mold surface 71. The second mold 8 includes a second mold surface 81 for molding at least a portion of the outer surface 23 of the casing 2. The second mold surface 81 has a facing portion 82 facing the first end face 12*a* of the collar portion 12 of the shaft portion 11 of the shaft member 1. A portion molded so as to face the facing portion 82 equals to the above-described partial surface 24.

At least in the facing portion 82, the first distance d1 between the first end face 12*a* of the collar portion 12 and the second mold face 81 is established so as to be longer than the second distance d2 between the second end face 12*b* of the collar portion 12 and the bearing surface 13*a* of the stepped section 13. On a surface located at an extended position from the outer circumferential surface 12*c* in the direction of the axis L, the first distance d1 between the outer surface 23 and the first end face 12*a* is surely longer than the second distance d2 between the second end face 12*b* and the bearing surface 13*a*. Further, the first area s1 of the first end face 12*a* is larger than the second area s2 of the second end face 12*b* (see FIG. 4). Accordingly, when resin is injected in the cavity 9, the injected resin mainly flows through the resin flow passage defined between the first end face 12*a* and the second mold surface 81 and therefore a pressure of the resin flowing through the resin flow passage defined between the first end face 12*a* and the second mold surface 81 is larger than a pressure of the resin flowing through the resin flow passage defined between the second end face 12*b* and the first mold surface 71. Accordingly, the bearing surface 13*a* is pressed against the first mold surface 71 as shown by the black arrow in FIG. 5. Consequently, the shaft member 1 is retained in a stationary condition in the cavity 9 inside the first mold 7 during the insert-molding of the casing 2.

In addition, the bearing surface 13*a* of the stepped portion 13 is in contact with the first mold surface 71 with a relatively large area, thereby enabling the shaft member 1 to be positioned precisely perpendicular to an inside of the casing 2.

As described above, the insert-molding of the casing 2 is easily controlled without addition of a supporting mechanism retaining the shaft member 1 in an appropriate position in the insert-molding mold 6. Additionally, the rate of defective parts may be reduced.

With the insert-molding mold 6, the bearing 13*a* is formed so as to be in plane with the inner surface 22 of the casing 2 and thus serves as the standard for positioning the shaft member 1 relative to the casing 2. Accordingly, the bearing surface 13*a* is used as a bearing on which the rotor 3 is rotatably supported. Since the shaft member 1 is made of metal, neither the casing 2 is worn nor the rotor 3 is burned. Accordingly, the rotor 3 is prevented from axially vibrating and rotating irregularly.

As described above, since the bearing surface 13*a* and the inner surface 22 of the casing 2 in the vicinity of the bearing surface 13*a* are arranged in plane with each other, a shape of the inner surface 22 of the casing 2 is determined based on the bearing surface 13*a*. Meanwhile, since the rotor 3 is rotatably supported on the bearing surface 13*a*, a rotation trajectory of the rotor 3 is easily determined. Accordingly, the casing 2 and the rotor 3 are positioned only in a certain small amount of clearance, thereby realizing a compact electric water pump P.

As described above, for example, since the first area s1 of the first end face 12*a* is larger than the second area s2 of the second end face 12*b*, the electric water pump P including the shaft member 1 configured as shown in FIG. 8 and FIG. 9 as well as the electric water pump P including the shaft member 1 configured as shown in FIG. 7 have no trouble of loosening of the shaft member 1 from the casing 2. Further, although not shown, a distance between the first mold 7 and the second mold 8 may be adjustable when thickness is added to the collar portion 12 and the stepped portion 13 in the direction of the axis L according to need. Furthermore, the supporting through-hole 72 may be large so as to enlarge the size of the shaft member 1 according to need. In such case, caution should be exercised so as not to create a clearance between the outer circumferential surface 13*b* and the supporting through-hole 72 when the shaft portion 11 is inserted into the supporting through-hole 72.

As described above, the collar portion 12 having the outer diameter larger than the outer diameter of the shaft portion 11 is embedded in the casing 2. Accordingly, even when a bending moment and a pulling force act on the connecting portion between the shaft member 1 and the casing 2 in accordance with the rotation of the rotor 3, the first end face 12*a* and the second end face 12*b* facing the first end portion 14 and the second end portion 15 of the shaft portion 11, respectively, engage with the resin of the casing 2. Consequently, the strong connecting strength of the connecting portion is obtained. The connecting strength between the shaft member 1 and the casing 2 in the electric water pump P of the embodiment is stronger, compared to the conventional connecting method in which the recessed and convex shapes of the surface of the shaft member increase the connecting strength between the shaft member and the resin of the casing. Thus the shaft member 1 is further prevented from being loosened from the casing 2, therefore realizing a high-power electric fluid pump that is not easily damaged even when an operating duty for the electric water pump P is increased, for example, for rotating the electric water pump P at high speeds.

Further, when the outer diameter of the collar portion 12 is enlarged, a contact surface between a portion of the shaft member 1 embedded in the casing 2 and the resin is further enlarged and the connecting strength between the shaft member 1 and the resin against a turning force, a bending moment, and a pulling force applied to the shaft member 1 is further increased, compared to the case where the shaft member 1 is enlarged in the direction of the axis L. As a result, without enlarging a portion of the shaft member 1, which is inserted in the insert-molding mold 6, the shaft member 1 is firmly fixed to the casing 2 and a compact electric fluid pump P is realized.

Furthermore, the bearing surface 13*a* facing the second end portion 15 of the shaft portion 11 serves as the bearing on which the rotor 3 is rotatably supported, thereby preventing the casing 2 from being worn due to the rotation of the rotor 3. Accordingly, the rotor 3 is prevented from vibrating axially and rotating irregularly. For example, even when the rotor 3 is worn and required to be replaced by a new rotor, it is not necessary for the casing 2 to be replaced by a new casing. Consequently, the ease of maintenance of the electric water pump P is increased.

According to the aforementioned embodiment, the bearing surface 13*a* of the stepped section 13 is in plane with the inner surface 22 of the casing 2.

Since the bearing surface 13*a* is arranged in plane with the inner surface 22 of the casing 2, the bearing surface 13*a* acts as the standard for positioning the shaft member 1 relative to the casing 2. Accordingly, the insert-molding process for molding the casing 2 may be easily controlled. Further, the positioning accuracy between the shaft member 1 and the casing 2 is increased, therefore increasing an operating accuracy of the rotor 3. That is, vibrations caused by the rotation of the rotor 3 are reduced and the deterioration of the connecting strength between the shaft member 1 and the casing 2 is further prevented.

According to the aforementioned embodiment, the casing includes the coil 21 while the rotor 3 includes the permanent magnet 31, and the rotor 3 is rotated by an electromagnetic force generated by the coil 21.

Since the connecting strength between the shaft member 1 and the casing 2 is strong, a high-end electric water pump P that is not easily damaged even when the rotor 3 is rotated at high speeds by the electromagnetic force is realized.

According to the aforementioned embodiment, the electric water pump P further includes the housing 4 having the suction port 41 and the discharge port 42 and the impeller vane 5 arranged in the housing 4 and attached to the rotor 3. In the electric water pump P, cooling water is suctioned from the suction port 41 and discharged from the discharge port 42 when the impeller vanes 5 integrally rotate with the rotor 3.

Since the connecting strength between the shaft member 1 and the casing 2 is strong, loosing of the shaft member 1 from the casing 2 is prevented even when a large load is applied to the rotor 3 via the impeller vanes 5. As a result, a highly durable electric fluid pump P that feeds a large volume of cooling water is obtained.

According to the aforementioned embodiment, the collar portion 12 includes the first and second end faces 12*a*, 12*b* facing the first end portion 14 and the second end portion 15 of the shaft portion 11, respectively, and the outer circumferential surface 12*c*. Further, the casing 2 includes the partial surface 24 of the outer surface 23 of the casing 2, which faces the first end face 12*a* of the collar portion 12. Furthermore, the first area s1 of the first end face 12*a* having the first distance d1 relative to the outer surface 23 is larger than the second area s2 of the second end face 12*b* and the first distance d1 in the vicinity of the outer circumferential surface 12*c* of the collar portion 12 is longer than the second distance d2 in the vicinity of the outer circumferential surface 12*c* of the collar portion 12. The first distance d1 is set to be longer than a second distance d2 defined between the second end face 12*b* of the collar portion 12 and the bearing surface 13*a* of the stepped section 13.

In addition, the resin flow passage in the vicinity of the partial surface 24 is set to be larger than the resin flow passage defined between the second end face 12*b* and the first mold 7 in which the shaft member 1 is set. Further, the inlet port of the resin flow passage in the vicinity of the partial surface 24 is set to be larger than the inlet port of the resin flow passage defined between the second end face 12*b* and the first mold 7 into which the shaft member 1 is set. Consequently, resin filled in the insert-molding mold 6 mainly flows in the resin flow passage in the vicinity of the partial surface 24 and a pressure of the resin, which is applied to the first end face 12*a*, is larger than a pressure of the resin, which is applied to the second end face 12*b*. As a result, the bearing surface 13*a* is pressed against the first mold 7 and the shaft member 1 is retained in a stationary condition in the cavity 9 during the insert-molding of the casing 2. Thus the bearing surface 13*a* is effectively used as the standard for positioning the shaft member 1 relative to the casing 2, thereby enabling the shaft member 1 to be embedded in an appropriate position in the casing 2.

As mentioned above, since the shaft member 1 is retained in the first mold 7 in a condition where the bearing surface 13*a* is in contact with the first mold surface 71, the shaft member 1 is easily positioned relative to the cavity 9 and a waste of time in setting the shaft member 1 in the insert-molding mold 6 is avoided. As a result, a manufacturing process for the insert-molding the casing 2 of the electric water pump P is shortened.

According to the aforementioned embodiment, the second mold 8 includes the second mold surface 81 facing the first mold surface 71 of the first mold 7, having the facing portion 82 facing the first end face 12*a* of the collar portion 12, and used for molding the outer surface 23 of the casing 2. Further, the first area s1 of the first end face 12*a* having the first distance d1 relative to the second mold surface 81 is larger than the second area of the second end face 12*b*. The first distance d1 in the vicinity of the outer circumferential surface 12*c* of the collar portion 12 is set to be larger than the second distance d2 in the vicinity of the outer circumferential surface 12*c* of the collar portion 12. Furthermore, the first distance d1 is set to be longer than the second distance d2 defined between the second end face 12*b* of the collar portion 12 and the bearing surface 13*a* of the stepped section 13.

In the facing portion 82 of the second mold surface 81, the first area s1 of the first end face 12*a* having the first distance d1 relative to the second mold surface 81 is larger than the second area s2 of the second end face 12*b* in a condition where the bearing surface 13*a* is in contact with the first mold surface 71. Further, the inlet port of the resin flow passage in the vicinity of the facing portion 82 is set to be larger than the inlet port of the resin flow passage between the second end face 12*b* and the first mold 7 in which the shaft member 1 is set. Consequently, when resin is injected in the insert-molding mold 6, the injected resin mainly flows through the resin flow passage between the first end face 12*a* and the second mold surface 81. Thus a pressure of the resin flowing through the resin flow passage between the first end face 12*a* and the second mold surface 81 is larger than a pressure of the resin flowing through the resin flow passage between the second end face 12*b* and the first mold surface 71. As a result, the bearing surface 13*a* is pressed against the first mold surface 71 and the shaft member 1 is retained in a stationary condition in the cavity 9 during the insert-molding of the casing 2. Thus the bearing surface 13*a* is effectively used as the standard for positioning the shaft member 1 relative to the casing 2, thereby enabling the shaft member 1 to be embedded in an appropriate position in the casing 2.

Additionally, the bearing surface 13*a* is exposed to the inside of the casing 2, the bearing surface 13*a* is used as the bearing on which the rotor 3 is rotatably supported, thereby preventing wear of the casing 2.

Moreover, since the bearing surface 13*a* is formed in plane with the inner surface 22 of the casing 2, a further compact electric fluid pump P in the direction of the axis L is realized, compared to the case where the bearing surface 13*a* is arranged in an intermediate portion of the shaft member 1.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. An electric fluid pump, comprising: a casing; a rotor arranged in the casing; and a shaft member supported by the casing and including a shaft portion extending in the casing in a direction of an axis of the shaft member, having a first end portion arranged at one axial end of the shaft member and a second end portion arranged at the other axial end of the shaft member, and supporting the rotor, a collar portion arranged at the first end portion of the shaft portion and having an outer diameter larger than an outer diameter of the shaft portion, and a stepped section positioned closer to the second end portion of the shaft portion than the collar portion, and including an outer diameter smaller than the outer diameter of the collar portion and larger than the outer diameter of the shaft portion, the stepped section being configured to have an end face facing toward the second end portion of the shaft portion and serving as a bearing surface on which the rotor is rotatably supported, the collar portion possessing a first axial end face facing towards the first end portion of the shaft and a second axial end face facing towards the second end portion of the shaft portion, the collar portion being embedded in the casing so that material forming the casing contacts both the first axial end face and the second axial end face, wherein the casing includes a partial surface of an outer surface, the partial surface facing the first axial end face of the collar portion and being spaced apart from the first axial end face of the collar portion, the first end portion of the shaft portion includes an end surface facing the partial surface of the outer surface of the casing and being spaced apart from the partial surface of the outer surface of the casing, the end surface of the first end portion of the shaft portion contacts the material forming the casing and contacting both the first axial end face and the second axial end face of the collar portion, and the bearing surface of the stepped section is coplanar with an inner surface of the casing and serves as a standard for positioning the shaft member relative to the casing.

2. The electric fluid pump according to claim 1, further comprising a coil embedded in the casing, wherein the rotor includes a permanent magnet, and the rotor is rotated by an electromagnetic force generated by the coil.

3. The electric fluid pump according to claim 1, further comprising a housing having a suction port and a discharge port and an impeller vane arranged in the housing and attached to the rotor, wherein a cooling water is suctioned from the suction port and discharged from the discharge port when the impeller vane integrally rotates with the rotor.

4. The electric fluid pump according to claim 2, further comprising a housing having a suction port and a discharge port and an impeller vane arranged in the housing and attached to the rotor, wherein a cooling water is suctioned from the suction port and discharged from the discharge port when the impeller vane integrally rotates with the rotor.

5. The electric fluid pump according to claim 1, wherein the first axial end face of the collar portion possesses a first area larger than a second area of the second axial end face of the collar portion, the first axial end face of the collar portion being axially spaced from the outer surface of the casing by a first distance, the second axial end face of the collar portion being axially spaced from the bearing surface of the stepped section by a second distance, the first distance being greater than the second distance.

6. The electric fluid pump according to claim 2, wherein the first axial end face of the collar portion possesses a first area larger than a second area of the second axial end face of the collar portion, the first axial end face of the collar portion being axially spaced from the outer surface of the casing by a first distance, the second axial end face of the collar portion being axially spaced from the bearing surface of the stepped section by a second distance, the first distance being greater than the second distance.

7. The electric fluid pump according to claim 3, wherein the first axial end face of the collar portion possesses a first area larger than a second area of the second axial end face of the collar portion, the first axial end face of the collar portion being axially spaced from the outer surface of the casing by a first distance, the second axial end face of the collar portion being axially spaced from the bearing surface of the stepped section by a second distance, the first distance being greater than the second distance.

8. The electric fluid pump according to claim 4, wherein the first axial end face of the collar portion possesses a first area larger than a second area of the second axial end face of the collar portion, the first axial end face of the collar portion being axially spaced from the outer surface of the casing by a first distance, the second axial end face of the collar portion being axially spaced from the bearing surface of the stepped section by a second distance, the first distance being greater than the second distance.

9. The electric fluid pump according to claim 1, wherein the shaft member includes a protruding portion protruding radially outwardly from an outer circumferential surface of the stepped section, or an outer circumferential surface portion of the collar portion includes a groove.

10. The electric fluid pump according to claim 2, wherein the shaft member includes a protruding portion protruding radially outwardly from an outer circumferential surface of the stepped section, or an outer circumferential surface portion of the collar portion includes a groove.

11. The electric fluid pump according to claim 3, wherein the shaft member includes a protruding portion protruding radially outwardly from an outer circumferential surface of the stepped section, or an outer circumferential surface portion of the collar portion includes a groove.

12. The electric fluid pump according to claim 4, wherein the shaft member includes a protruding portion protruding radially outwardly from an outer circumferential surface of the stepped section, or an outer circumferential surface portion of the collar portion includes a groove.

13. An electric fluid pump, comprising: a casing made of resin; a rotor arranged in the casing; a shaft member supported by the resin casing and including a shaft portion extending in the casing in an axial direction of the shaft member, having a first end portion at one axial end of the shaft member and a second end portion at an opposite axial end of the shaft member, and supporting the rotor, a collar portion at the first end portion of the shaft portion having an outer diameter larger than an outer diameter of the shaft portion, the collar portion possessing a first axial end surface facing towards the first end portion of the shaft and a second axial end surface facing towards the second end portion of the shaft portion, the collar portion also possessing an outer circumferential surface, the collar portion being embedded in the resin casing so that the resin casing contacts the first axial end surface of the collar portion, the second axial end surface of the collar portion and the circumferential outer surface of the collar portion, and a stepped section positioned closer to the second end portion of the shaft portion than the collar section, the stepped section possessing an outer diameter smaller than the outer diameter of the collar portion and larger than the outer diameter of the shaft portion, the stepped section possessing an axial end surface which is a bearing surface on which the rotor is rotatably supported, wherein the casing includes a partial surface of an outer surface, the partial surface facing the first axial end surface of the collar portion and being spaced apart from the first axial end surface of the collar portion, the first end portion of the shaft portion includes an end surface facing the partial surface of the outer surface of the casing and being spaced apart from the partial surface of the outer surface of the casing, the end surface of the first end portion of the shaft portion contacts the resin forming the casing and contacting both the first axial end surface and the second axial end surface of the collar portion, and the bearing surface of the stepped section is coplanar with an inner surface of the casing and serves as a standard for positioning the shaft member relative to the casing.

* * * * *